United States Patent [19]

Coker et al.

[11] 4,214,958

[45] Jul. 29, 1980

[54] ELECTROLYSIS OF ALKALI METAL HALIDES IN A THREE-COMPARTMENT CELL WITH A PRESSURIZED BUFFER COMPARTMENT

[75] Inventors: Thomas G. Coker, Waltham; Anthony B. LaConti, Lynnfield; Edward N. Balko, Wilmington; George B. McGray, Wakefield, all of Mass.

[73] Assignee: General Electric Company

[21] Appl. No.: 38,812

[22] Filed: May 14, 1979

[51] Int. Cl.[2] ..... C25B 1/34; C25B 9/00

[52] U.S. Cl. ..... 204/98; 204/128; 204/263; 204/266

[58] Field of Search ..... 204/98, 128, 263–266

[56] References Cited

U.S. PATENT DOCUMENTS

| | | | |
|---|---|---|---|
| 3,954,477 | 5/1976 | Arisaka | 96/76 R |
| 4,124,477 | 11/1978 | Tokawa et al. | 204/296 |

*Primary Examiner*—R. L. Andrews

*Attorney, Agent, or Firm*—I. David Blumenfeld

[57] ABSTRACT

The invention describes a pressurized, three compartment membrane cell for the electrolyzing aqueous alkali metal halides at low cell voltages and with high cathodic current efficiencies. Unitary electrode-electrolyte structures, in the form electrochemically active electrodes physically bonded to ion transporting permselective membranes divide the cell into anode, cathode and buffer compartments. The buffer compartment feed is pressurized to maintain at a positive pressure differential with respect to the anode and cathode compartment feeds. The flexible unitary electrode-membrane electrolytes are forced outwardly against electronically conductive anode and cathode current collectors to provide uniform, constant and controllable contact between the bonded electrodes and thereby minimizing ohmic losses. A three compartment cell operated in this fashion not only minimizes the voltage required to electrolyze the halide solution, but also increases the cathodic current efficiency at high caustic concentrations by providing multiple hydroxide rejection stages in a single cell process. The improvement in cathodic current efficiency is realized by forming a lower caustic concentration in the buffer compartment than in the cathode compartment thereby reducing backmigration of $OH^-$ ions into the anode compartment.

26 Claims, 4 Drawing Figures

ELECTROLYSIS OF ALKALI METAL HALIDES IN A THREE-COMPARTMENT CELL WITH A PRESSURIZED BUFFER COMPARTMENT

BACKGROUND OF THE INVENTION

The instant invention relates to a process and apparatus for the electrolytic production of halogens and alkali metal hydroxides from aqueous alkali metal halide solutions. More particularly, it relates to the electrolysis of brine in a three compartment membrane cell in which the anode and cathode electrodes are physically bonded to the permeselective membranes.

It is now well known to electrolyze brine and other halides in electrolytic cells containing anode and cathode compartments separated by a liquid and gas impervious permselective membrane. The voltages required for electrolysis of halides in a membrane cell are, however, relatively high; one of the reasons being that the anode and cathode electrodes are physically separated from the permselective membrane. This introduces IR drops due to the layers of electrolyte between the membrane and the electrodes and IR drops due to gas blinding effects as bubbles of evolved chlorine and hydrogen gas are formed between the electrochemically active gas evolving electrodes and the membrane.

In an application, Ser. No. 922,316 filed July 6, 1978, in the names of LaConti, et al, assigned to the General Electric Company, the assignee of the present invention, a process for producing alkali metal hydroxides and halogens is described in which the electrochemically active anode and cathode electrodes, in the form of bonded porous masses of electrocatalytic and polymeric particles are bonded directly to and are embedded in the membrane to form a unitary electrode-electrolyte structure. Substantial reductions in cell voltages are realized because electrolysis occurs essentially at the interface of the bonded electrode and the membrane, and electrolyte IR drops and the IR drops due to gas blinding effects are minimized. Good contact must be maintained between the anode and cathode current collectors and the bonded electrodes in order to minimize ohmic losses at the collector/electrode interface. In the aforesaid application Ser. No. 922,316, and other cells of this type the current collectors are clamped between the housing and membrane to maintain good contact by mechanical, hydraulic or other clamping means.

In accordance with the present invention, Applicants have found that excellent contact at the electrode/current interface may be maintained and ohmic losses at the interface minimized by utilizing a three compartment cell in which the center or buffer compartment is operated at a positive pressure with respect to the other compartments. This forces the unitary membrane/electrode structure against the current collectors establishing uniform, constant, and controllable contact pressure thereby resulting in optimum cell voltages.

In addition to lowering the cell voltage required for halide electrolysis, the cathodic current efficiency at high caustic concentrations can also be increased substantially because a substantial portion of back migrating hydroxyl ions are discharged from the buffer compartment as sodium hydroxide. This reduces back migration of $OH^-$ ions through the anode membrane substantially. Improvement in current efficiency may therefore, be achieved by producing sodium hydroxide at a lower concentration in the buffer compartment along with highly concentrated caustic in the cathode compartment. Concentrated caustic can now be produced using cathode membrane with relatively low hydroxyl ions rejection characteristics and low electrical resistance without affecting the overall current efficiency. This is achieved, by in effect, incorporating multiple hydroxide rejection stages in a single cell process.

In preferred embodiments of the invention the permselective membranes, are hydrolyzed copolymers of polytetrafluoroethylene and perfluorosulfonylethoxy vinyl ethers having equivalent weights of in the range of 900–1700. Two such permselective membranes are utilized along with an outer housing frame to form the buffer compartment between anode and cathode compartments. The buffer compartment is operated with a pressurized distilled water or dilute caustic cathode feed thereby forcing the membranes outward into firm contact with the current collectors in the anode and cathode compartments.

Electrolysis of brine with cell voltages of 3.3 to 3.5 volts at 300 ASF with current efficiencies of 90% or more are readily achievable using permselective cathode membranes which have relatively low hydroxyl rejection characteristics and low electrical resistance.

It is, therefore, a principal objective of this invention to provide a three compartment electrolytic cell and a process for generating halogens and alkali metal hydroxides therein while minimizing cell electrolysis voltages.

Another objective of the invention is to provide a three compartment electrolytic cell and an electrolysis process carried out therein in which the buffer compartment is operated at a positive pressure differential to maintain uniform, constant and controllable contact between electrodes physically bonded to permselective cell membranes, and current collectors associated therewith.

Still another objective of the invention is to provide a highly efficient three compartment electrolytic cell and a process for generating chlorine and caustic in which the cell electrolysis voltage is minimized by maintaining uniform, constant and controllable contact pressure between electrodes bonded to the membranes and current collectors through a buffer compartment operated at a positive pressure with respect to the other compartment.

Other objectives and advantages of the invention will become apparent as the description thereof proceeds.

The objectives and advantages of this invention are realized by providing an electrolytic cell having a pair of permselective membranes, preferably cation membranes, which divide the cell into an anode, cathode, and buffer chambers. The two gas and liquid impervious permselective membranes have electrodes bonded to those surfaces which face the anode and cathode chambers respectively. The electrodes which are bonded masses of electrochemically active and polymeric particles, are bonded to and embedded in the surface of the membrane. Current collectors which are connected to an electrolysis voltage source are positioned in physical contact with the electrochemically active electrodes. Distilled water or a dilute solution of caustic is introduced into the buffer compartment as a positive pressure with respect to the anode and cathode compartments. The positive pressure forces the membranes outward into firm contact with the current collectors thereby maintaining a uniform constant contact pressure which minimizes ohmic losses between the current collector and the electrode. By maintaining a positive pressure differential of at least 0.5 psi and up to 5 psi; and preferably in a range of 1–2 psi, electrolysis cell voltages in the range of 3.35 to 3.5 volts at current densities of 300 ASF foot are readily achievable and represent voltage improvements ranging from 0.6 to 1.5 volts over conventional three compartment cells operated at 300 ASF.

The novel features which are believed to be characteristic of this invention are set forth in the appended claims. The invention itself, however, both as to its organization and mode of operation, together with further objectives and advantages thereof, may be best understood by reference to the following description taken in connection with the accompanying drawings in which:

Figure 1:
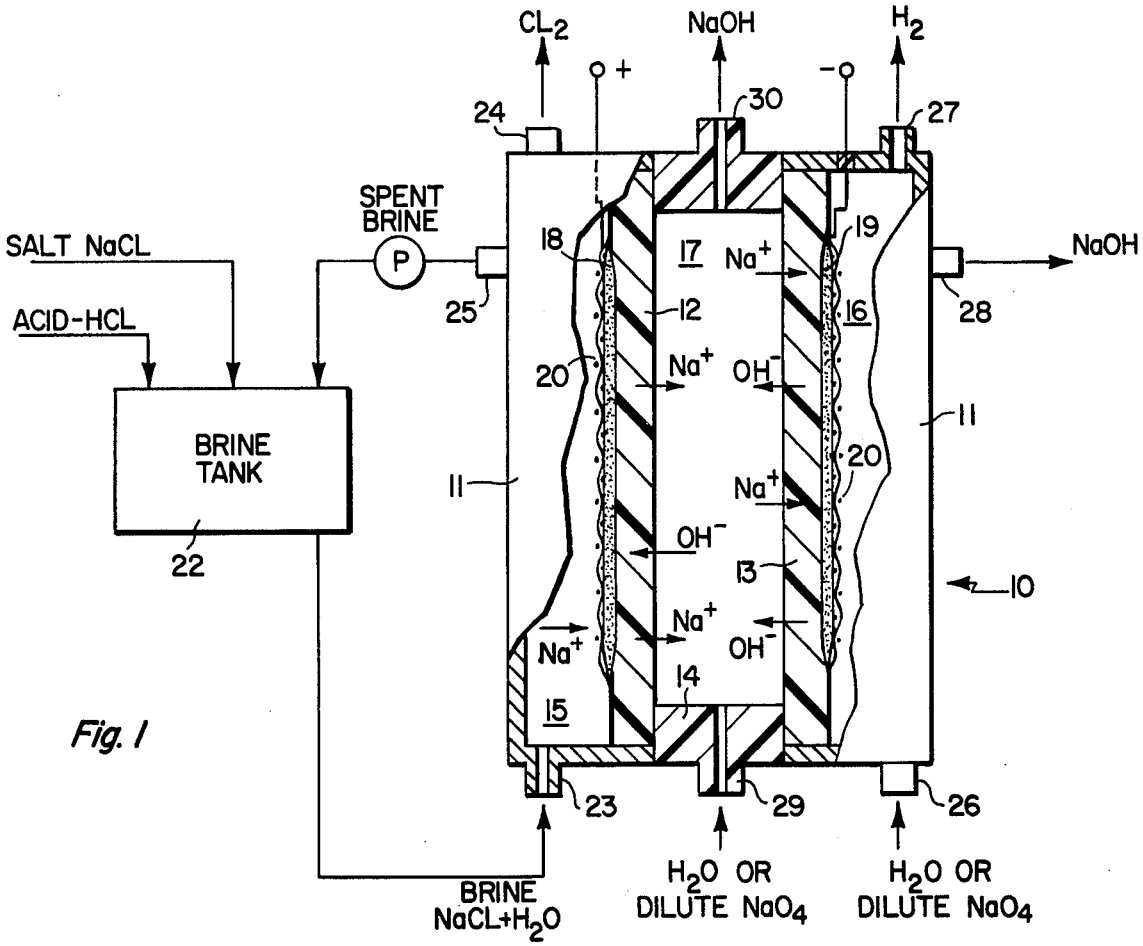
FIG. 1 is a schematic diagram of a three compartment electrolytic cell utilizing permselective membranes having catalytic electrodes bonded directly to the surfaces thereof.

FIG. 1 is a schematic illustration of a three compartment cell for electrolyzing alkali metal halides to produce halogens and alkali metal hydroxides. Cell 10 includes a housing 11 which is divided by gas and essentially liquid impervious permselective membranes 12 and 13 and a nonconductive buffer chamber frame 14 into an anode compartment 15 a cathode compartment 16 and a buffer compartment 17. Anode and cathode electrodes 18 and 19 are respectively bonded to and embedded in the surfaces of membranes 12 and 13 which face the anode and cathode chambers respectively. The anode and cathode electrodes, as will be described in detail later, are porous and gas permeable, and comprise bonded masses of electrocatalytic and polymeric particles. The catalytic particles are preferably particles of stabilized reduced oxides of a platinum group metal or dispersions of reduced metal particles and may include reduced oxides of a valve metal as well as electroconductive extenders such as graphite. The polymeric particles are preferably fluorocarbon particles such as polytetrafluoroethylene. The bonded mass of catalytic and polymeric particles is itself bonded to and embedded to the surface of the membrane by the application of heat and pressure so that the electrode is dispersed over the major part of the membrane. As a result, a great number of individual particles contact the membrane at a plurality of points.

Positioned adjacent to and in physical current exchanging contact with the anode and cathode electrodes are anode and cathode current collectors 20 and 21 which are connected through suitable conductors to the positive and negative terminals of a voltage source to supply current to the electrodes for electrolysis of the anolyte and catholyte.

An aqueous solution of an alkali metal halide, preferably brine, in the case of chlorine and caustic production, is fed to the anolyte compartment through conduit 23 from brine tank 22. Chlorine gas is removed from the anode compartment through an exit conduit 24 and depleted brine is removed and fed back to brine tank 22 through conduit 25. Similarly, an aqueous catholyte in the form of water or dilute caustic is introduced into the catholyte compartment through inlet conduit 26 and hydrogen gas is removed through outlet conduit 27 and concentrated caustic through outlet conduit 28. Distilled water or a dilute solution of caustic is introduced into buffer compartment 17 through an inlet conduit 29. Dilute caustic which includes caustic formed in the buffer compartment from sodium ions from the anode chamber and back migrating hydroxyl ions from the cathode, is withdrawn through an outlet conduit at 30. The dilute caustic from outlet 30 of the buffer compartment 17 may be utilized directly or may be fed back and utilized as the dilute caustic catholyte.

The brine solution from brine tank 22 contains from 150–320 grams of NaCl per liter. The chloride ion is reacted at the anode electrode to produce chlorine gas. The brine may be acidified to minimize evolution of oxygen by the electrolysis of back migrating hydroxyl ions. HCl or other acids may be added to brine tank 22 to maintain the pH of the brine below 6 and preferrably between 2–3.5.

Sodium ions and water molecules are transported across anode membrane 12 into buffer compartment 17. The buffer compartment feed, as pointed out previously, is either distilled water or dilute caustic. Some of the sodium ions transported through the anode membrane are discharged with hydroxyl ions which have back migrated through the cathode membrane. The remaining sodium ions and associated water molecules are transported across the cathode membrane. Water molecules from the catholyte feed are decomposed at the cathode electrode to form hydrogen and hydroxyl ions. The gaseous hydrogen and the caustic produced at the cathode are then discharged from the electrolyzer and separated for utilization. The reactons occuring in the three compartment electrolyzer are as follows:

At the anode: $Cl^- \longrightarrow \frac{1}{2} Cl_2 + e^-$ (1)

Across the anode membrane: $\underset{OH^-}{\overset{Na^+,\ H_2O}{\rightleftharpoons}}$ (2)

In the center compartment: $\xrightarrow{Na^+,\ H_2O}$ (3)

Across the cathode membrane: $\underset{OH^-}{\overset{Na^+,\ H_2O}{\rightleftharpoons}}$ (4)

At the cathode: $H_2O + e^- \longrightarrow OH^- + \frac{1}{2} H_2$ (5)

Overall Reaction: $H_2O + Cl^- \longrightarrow \frac{1}{2} Cl_2 + \frac{1}{2} H_2 + OH^-$ Since a substantial portion of the hydroxyl ions back migrating across the cathode membrane are removed from the buffer compartment in the dilute caustic effluent from this compartment the quantity of hydroxyl ions which migrate to the anode chamber through the anode membrane is substantially reduced and cathodic current efficiencies of 90% or higher are readily achieved.

More specifically it is possible to obtain high current efficiency using cathode membranes which have relatively poor hydroxyl rejection characteristics. This, or course, is contrary to prior art approaches in two compartment cells in which membranes, or membrane layers, with high hydroxide rejection characteristics are required at the cathode side of the membrane in order to limit or minimize back migration of hydroxyl ions.

The buffer compartment is operated with a positive pressure differential visa-vis the anode and cathode compartment thereby forcing the membranes against the current collectors to maintain uniform, constant, and controllable contact pressure thereby minimizing ohmic losses due to electrolyte IR drops and IR drops introduced by formation of chlorine and hydrogen gas films or bubbles between the electrodes and their associated current collectors.

It has been found that a minimum pressure differential of 0.5 psi is required to maintain adequate contact between the electrode and current collector. Below 0.5 psi partial separation between the current collectors and the electrode can result in the current collectors functioning, in part, as the electrochemically active electrodes. The higher chlorine overvoltage characteristics of the current collectors contribute to the rise in cell voltage. Furthermore, erratic and varying IR drops are introduced by chlorine and hydrogen gas films or bubbles formed between the membrane and the current collectors as contact is lost. In fact, below 0.5 psi not only does the voltage rise rapidly but voltage fluctuations from 0.1 volts to 0.5 volts are noted. As contact between current collector and electrode diminishes additional resistances and IR drops are introduced until at some point the system no longer operates with the bonded catalytic particle, mass operating as the active electrode. While a 0.5 psi differential is a minimum, the differential pressure is preferably equal to or greater than 1 psi. Operation in the range of 1–5 psi is fully effective to produce constant, controllable and uniform current collector/electrode contact pressure with a range of 1–2 psi being preferred.

The permselective anode and cathode cation membranes are hydrolyzed copolymers of polytetrafluoroethylene and perfluorosulfonylethoxy vinyl ether. In a preferred embodiment the cation exchanging permselective membranes are composed essentially of the sulfonated form of the above membranes which are commercially available from the DuPont Company under its trade designation Nafion. The preferred Nafion membranes have equivalent weights from 900 to about 1700. By virtue of the three chamber operation, however, low equivalent weight membranes in the range of 1100 EW may be utilized even though they have a low hydroxyl ion rejection characteristic than do the higher equivalent weight membranes.

In addition to the Nafion copolymers with sulfonic acid or sulfonate ion exchanging functional groups, membranes having other functional groups such as carboxylic, phosphonic, etc. may also be used. Similarly, membranes which are chemically modified so that the sulfonyl fluoride functional groups are converted to form sulfonamide groups may also be used. Such chemical conversion may be readily achieved by reacting a layer of the Nafion membranes while in a sulfonyl fluoride form with ammonia, ethylene diamene (EDA), or other amines to form a sulfonamide membrane or layer. The sulfonamide membranes have good hydroxyl ion rejection characteristics are very effective as the anode membrane.

As described in detail in the aforesaid LaConti application, which is hereby incorporated by reference, the catalytic electrodes which are bonded to the permselective membranes include electrocatalytic particles of at least one reduced platinum group metal oxide produced, for example by the Adams methods of fusion of mixed metal salts or by other methods. The particles are thermally stabilized by heating the reduced oxides in the presence of oxygen. Examples of useful platinum group metals are platinum, palladium, platinum, iridium, rhodium, ruthenium, oxmium, and mixtures of these oxides. The preferred platinum group oxides for chlorine production are reduced oxides of ruthenium and/or iridium. The electrode may contain electrocatalytic particles of a single reduced platinum group metal oxide. It has been found, however, that mixtures of reduced platinum group metal oxides are more stable. Thus, anode electrodes of reduced oxides of ruthenium containing up to 25% of reduced oxides or iridium and preferably 5 to 25% by weight have been found very stable. One or more reduced oxides of valve metals such as titanium, tantalum, niobium, zirconium, hafnium, vanadium, or tungsten may be added to stabilize the electrode against oxygen, chlorine, and the generally harsh electrolsis conditions. Up to 50% by weight of the valve metal is useful with the preferred amount being 20–50% by weight. In addition, electroconductive extenders such as graphite which have excellent conductivity with low halogen overvoltages and which are substantially less expensive may be utilized in addition to the platinum group metals and valve metals. Graphite may be present in the amount up to 50% by weight, when added.

The cathode may similarly be a bonded mass of fluorocarbon and catalytic particles of a platinum group and a valve metal groups plus graphite. Alternatively, it may be a bonded mass of fluorocarbon and platinum black particles, or of nickel, cobalt carbide, steel, spinel, etc. particles.

The catalytic particles are combined with fluorocarbon particles and sintered to form the bonded mass of catalytic and polymeric particles. The fluorocarbons are preferably polytetrafluoroethylene which are available commercially from the DuPont Company under their trade designation Teflon. The Teflon content may be from 15 to 35 weight percent. The catalytic particles are mixed with the Teflon particles, placed in a mold and heated, under pressure if desired, until the mixture is sintered into a decal which is then bonded to the membrane. The sintering temperature used for Teflon ranges from 320°–450° C. with 350°–400° C. preferred.

Figure 2:
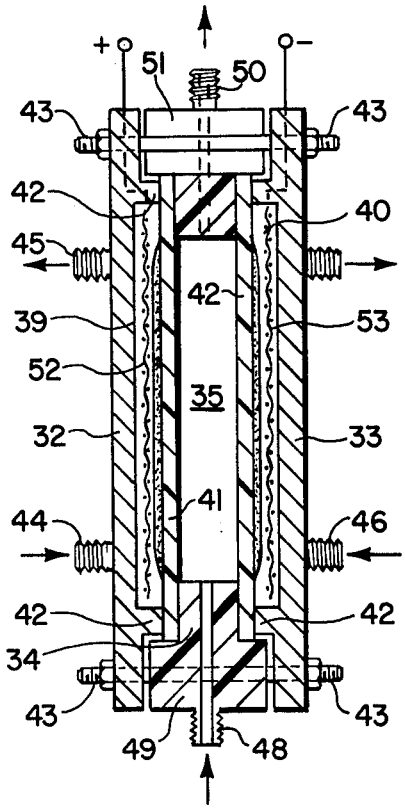
FIG. 2 is a sectional view of such a three compartment cell with permselective membranes, bonded electrodes, and the current collectors physically contacting said electrodes.
Figure 3:
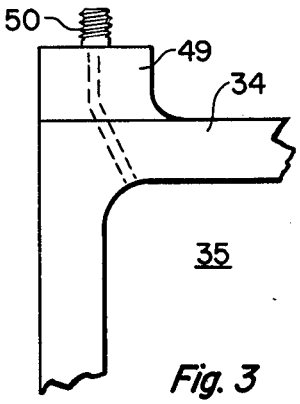
FIG. 3 is a partially broken away view of the buffer compartment frame shown in FIG. 2.

FIG. 2 illustrates a three chamber electrolysis cell constructed in accordance with the invention. The cell comprises an anode housing 32 fabricated of titanium or any other material which is resistant to anodic conditions, to acidified brine, and to electrolysis products, such as chlorine, etc. in the anode chamber. Cathode housing 33 may be fabricated or stainless steel or nickel, both of which are resistant to caustic, and is separated from the anode housing by a nonconductive frame 34 which defines a center or buffer compartment 35. Frame 34 may be fabricated of any nonconductive material which is resistant to caustic and may, for example, be fabricated of a fluoropolymer such as polyvinylidine fluoride which is commercially available from the Pennwalt Corporation under the tradename Kynar. The buffer compartment frame may be fabricated of other polymers such as polyvinylchloride, etc. The anode and cathode housing are both recessed to define anode and cathode compartments 39 and 40. The cathode and anode compartments are separated from the buffer compartment by gas and liquid impervious permselective membranes 41 and 42. The membranes are positioned on opposite sides of frame 34 and abut against an undercut sholders on opposite sides of frame 34. Clamping projections 42 extend from housings 32 and 33 and bear against the membranes and frame 34. The cell members are clamped firmly together by means of bolts 43 to hold the cell assembly in position and to clamp the anode and cathode membranes against buffer compartment frame 34. Acidified brine is introduced into the anode chamber through an inlet conduit 44 and the gaseous electrolysis product and spent brine moves through an outlet conduit 45. Similarly, distilled water or dilute caustic is introduced into the cathode chamber through inlet conduit 46 and hydrogen and concentrated caustic are removed through outlet conduit 47.

Distilled water or dilute caustic is introduced into the central or buffer compartment 35 through inlet conduit 48 which communicates with compartment 35 through suitable passages in frame header 49 and frame 34. A dilute caustic solution is removed through outlet conduit 50 which communicates with buffer compartment 35 through passages in frame header 51 and frame 34. Facing the anode and cathode chamber are electrodes which are bonded to and embedded in the membrane. The electrodes, pointed out previously are a bonded masses of electrocatalytic and polymeric particles. Positioned in the anode and cathode chambers are current collector screens 52 and 53 which fill the chamber and are in contact with the electrodes bonded to the membrane. The anode current collectors may be any material which has good conductivity and is resistant to the harsh electrolysis conditions in the anode chamber. Materials which have been found adequate are a titanium-paladium and Ti-Ni-Mo alloys such as those available commercially from the Timet Corporation. The cathode current collector 52 is made of any material which has good conductivity and is resistant to caustic and may typically be nickel or stainless steel screen. The current collectors in addition to being conductive must preferably be of an open construction for good fluid distribution to allow the electrolysis to contact the porous bonded electrodes so that electrolysis takes place within the electrode structure and preferably at the interface of the electrode and the permselective cation transporting membrane. Current conducting screens 52 and 53 are connected through insulated current conductors to the positive and negative terminals of the cell power supply.

Figure 4:
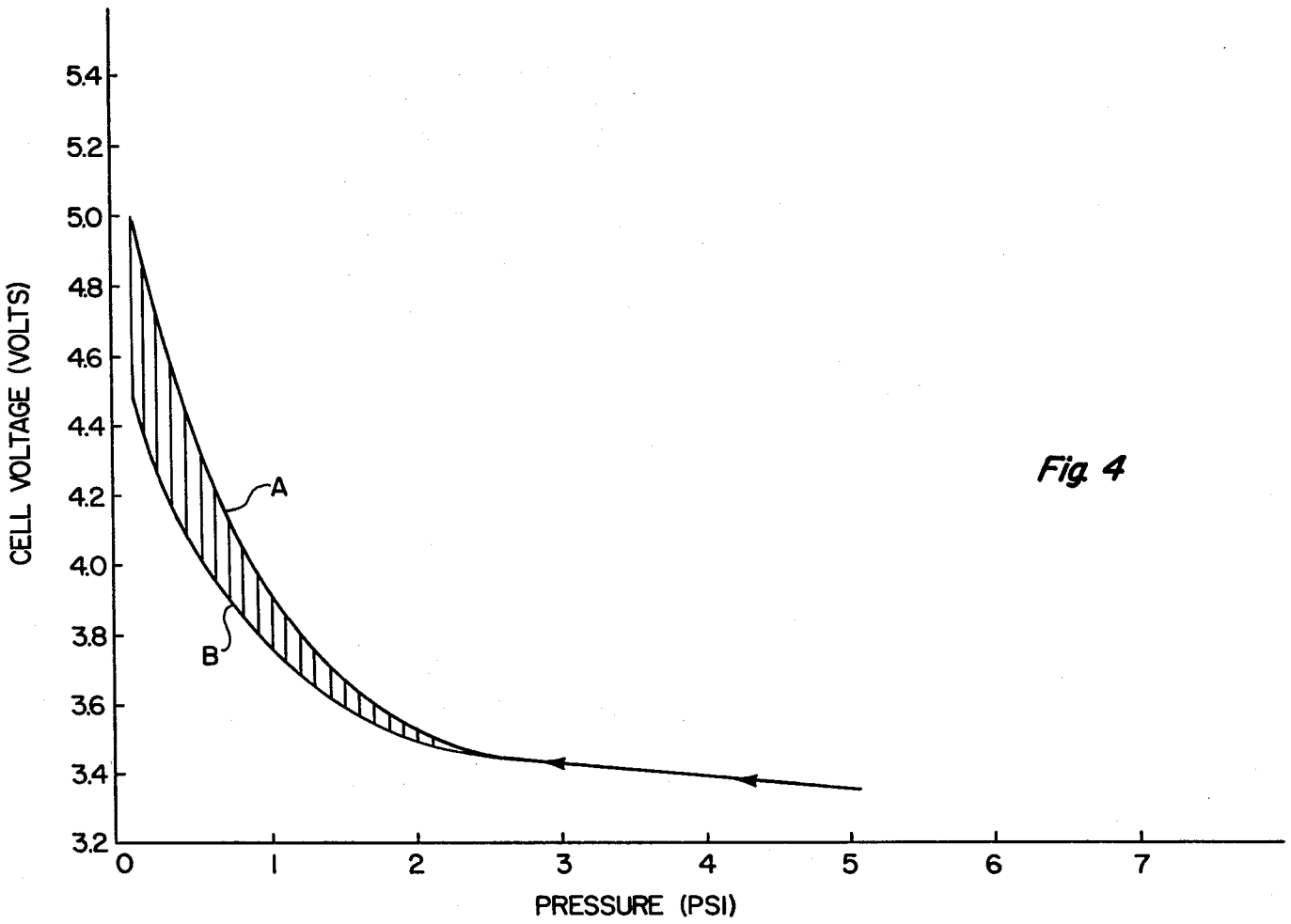
FIG. 4, is a graphic depiction of a cell voltage as a function of buffer compartment pressure.

A three compartment cell was constructed having a titanium anode housing, and a nickel cathode housing, separated by a 0.112 inch thick buffer compartment frame fabricated of Kynar (polyvinylidene fluoride). A 10 mil unsupported sulfonamide membrane of the type sold by DuPont under its trade designation Nafion 042 was used as the anode membrane and a 12 mil 1100 EW Nafion as the cathode membrane. A 3×3 inch electrode consisting of a mixture of (Ru-25% Ir) Ox electroconductive particles, with a loading of 6 mg/cm$^2$, bonded with 20 weight % of polytetrafluoroethylene particles of the type sold by DuPont under its trade designation T-30, was bonded to the anode membrane. The cathode consisted of a bonded mixture of platinum black and 15 weight % of T-30 tetrafluoroethylene. The platinum black loading was 4 mg/cm$^2$. The cathode current collector was a fine mesh nickel screen and the anode current collector was a fine mesh coated screen. Saturated sodium chloride at 79° C. was fed to the anode, an 0.5 molar NaOH solution to the buffer compartment, and distilled water to the cathode compartment. The cell was operated at a current density of 300 ASF and the buffer compartment feed pressure was varied from 0.2–5 lbs. psig. The anode feed was maintained at 1 lb. psig and the cathode compartment feed was atmospheric or 0.0 psig. The cell voltage was measured as the buffer compartment pressure varied over the entire range. FIG. 4 illustrates the relationship of cell voltage as a function of pressure. The buffer compartment pressure in psi is indicated along the abcissa and the cell voltage in volts along the ordinate. The shaded part between curves A and B represents voltage fluctuations as the center compartment pressure drops below approximately 1.3 psig or a pressure differential ($\Delta P$) of 0.3 psig relative to the anode compartment. As may be observed from the curve, cell voltage at a current density of 300 ASF and 2.3 psig ($\Delta P$ - 1.3 psig) was 3.45 volts. At a center compartment pressure of 1.4 psig ($\Delta P$ - 0.4 psig) the cell voltage rises to 3.6 to 3.68 volts. The voltage rise and the voltage fluctuation is due to some loss of contact at the anode thereby introducing electrolyte IR drops and IR drops due to pressence of gas bubbles or films between the anode current collector and the anode electrode. As the pressure drops below 1.4 ($\Delta P$=0.4 psig), the voltage increases until ultimately when the pressure in the center compartment feed approaches atmospheric, some current collector contact loss is also experienced at the cathode and the cell voltage fluctuates between 4.48–5.00 volts. Thus a pressure differential of at least 0.5 psi should be maintained. At 4 psig ($\Delta P$−3.0 psi) the cell voltage of 300 ASF is approximately 3.4 volts which is an improvement of 0.6 volts or better over conventional three compartment membrane cells operating at 300 ASF with anode and cathode electrodes separated and spaced from the membrane. At 5 psig ($\Delta P$−4 psig) the cell voltage is 3.36 volts. By operating at a $\Delta P$ of 1–2 psig the cell voltage is readily maintained between 3.45–3.55 volts.

The cell described in the foregoing example not only provided excellent performance in terms of cell voltage by operating with positive buffer compartment feed pressures but produced 8.8 molar sodium hydroxide in the buffer compartment with a cathodic current efficiency of 93% and anodic current efficiency of 91%.

EXAMPLE 2

In an alternative construction, a liquid pervious cathode diaphragm is utilized in place of a liquid impervious membrane with the diaphragm taking the form of a microporous Nafion 701. This porous Nafion configuration has a porosity such that the liquid flows from the buffer compartment to the cathode compartment. To this end, the buffer compartment is modified by eliminating the outlet conduit so that the buffer compartment is modified by eliminating the outlet conduit so that the buffer compartment feed passes through the diaphragm into the cathode compartment. The porosity is chosen that for a given feed flow rate into the buffer compartment, the flow through the porous membrane into the cathode compartment is such as to maintain adequate pressure in the buffer compartment to maintain proper contact between the bonded electrodes and the current collectors.

EXAMPLE 3

An additional cell was built as described in Example 1. However, the cathode and the buffer compartment feeds were both distilled water. AT 300 ASF, and 79° C. and a center compartment pressure of 4.3 psig $\Delta P=3.3$ psi cell voltage was 3.40 volts, cathodic efficiency was 93% the anodic current efficiency was 91% with a catholyte product of 8.8 molar NaOH and a center compartment product of 1.2 molar NaOH. The center and cathode compartment flow rates were 2.6 cc per min and 0.8 cc/min respectively.

EXAMPLE 4

A three compartment cell was constructed utilizing a titanium anode housing a DSA anode collector screen and an unsupported Nafion 227 anode membrane. Nafion 227 is a laminate of an 1100 EW Nafion and a thin sulfonamide skin. The sulfonamide was positioned facing the buffer compartment. The anode was a bonded mass of reduced ruthenium −25% Iridium oxide particles and 20 weight percent of polytetrafluoroethylene T-30 particles. The catalytic particle loading was 6 mg/cm$^2$. The buffer compartment utilized a 0.112 inch thick Kynar frame having the anode membrane on one side and an 1100 equivalent weight Nafion cathode membrane with a 4 mg/cm Pt. black −15 weight percent T-30 cathode on the other side. The cathode housing was nickel and the cathode current collector was a fine nickel screen. Saturated sodium chloride was fed to the anolyte compartment at 89° C. and a pressure of 1 psig, distilled water was fed to the catholyte compartment at atmospheric pressure and a 6.6 molar sodium hydroxide at 5.4 psig to the buffer compartment. At 304 amperes the cell voltage as 3.37 volts the anodic current efficiency was 90% for a 4.21 molar sodium hydroxide product from the cathode compartment.

EXAMPLE 5

Yet another cell was constructed utilizing a Nafion 315, 1500 EW laminate anode membrane and an 1200 EW Nafion 120 cathode membrane with a buffer compartment feed of distilled water at 3.0 psi and a catholyte feed of distilled water ambient pressure. The anode feed was saturated brine at 80° C. A cathodic current efficiency of 89% with a 10 molar caustic cathode product and a cell voltage of 3.7 volts was achieved.

It can be seen from the aforesaid data that by maintaining the center compartment feed at a positive pressure with respect to the anode and cathode chambers excellent current collectors/electrode contact may be maintained resulting in substantial reductions in the cell voltages at current densities of 300 ASF or more with cathode current efficiencies of ~90% or more at high caustic concentrations.

While the instant invention has been shown in connection with preferred embodiments thereof, the invention is by no means limited thereto, since other modifications of the instrumentalities employed and of the steps of the process carried out, may be made and fall within the scope of the invention. It is contemplated by the appended claims to cover any such modifications that fall within the true scope and spirit of this invention.

What we claim as new and desire to secure by Letters Patent of the United States is:

1. A process for producing halogens which comprises electrolyzing an aqueous alkali metal halide anolyte between anode and cathode electrodes separated by at least two ion transporting, membranes forming anode, cathode and buffer compartments, the electrochemically active elements of at least one of said electrodes being physically bonded to one of said membranes at a plurality of points to form a unitary electrode-membrane, applying potential from a potential source to said bonded electrode by an electron current conductor in contact with the bonded electrode, introducing a catholyte to the cathode chamber, introducing a pressurized aqueous feed to the buffer compartment to maintain a positive pressure differential between the buffer and the other compartments to force said membranes outward and maintain firm contact between the electrochemically active bonded electrode and the electron current conductor structure.

2. The process according to claim 1 wherein the anode electrode comprises a plurality of electrochemically active particles bonded to the membrane and the electron current conductor is a screen which bears against the anode.

3. The process according to claim 2 wherein the electron current conductor bearing against the anode has a higher halogen overvoltage than the bonded anode.

4. The process according to claim 1 wherein the cathode electrode comprises a plurality of electrochemically active particles bonded to the membrane and the electron current conductor is a screen which bears against the cathode.

5. The process according to claims 2 or 4 wherein the catalytic particles are bonded together by polymeric fluorocarbon particles.

6. The process according to claim 4 wherein the electron current conducting structure bearing against the cathode has a higher hydrogen overvoltage than the cathode.

7. The process according to claim 1 wherein the anode and cathode electrodes each comprise a plurality of electrochemically active particles bonded to the ion transporting membranes.

8. The process according to claim 7 wherein the buffer compartment is maintained at a positive pressure differential of at least 0.5 psi.

9. The process according to claim 7 wherein the catalytic particles forming the anode and cathode are bonded together by polymeric fluorocarbon particles.

10. The process according to claim 7 wherein the electron current conducting structure bearing against the anode and cathode respectively have higher halogen and hydrogen over-voltages than the anode and cathode.

11. The process according to claim 1 wherein the buffer compartment is maintained at a positive pressure differential of at least 0.5 psi.

12. The process according to claim 1 wherein the buffer compartment is maintained at a positive pressure differential in excess of 1 psi.

13. The process according to claim 1 wherein the positive buffer compartment pressure differential is 1–2 psi.

14. A process for producing chlorine and dilute aqueous casutic solutions of different concentrations in a cell having at least anode, cathode, and buffer compartments separated by liquid impervious ion transporting membranes which comprises electrolyzing an aqueous alkali metal chloride containing at least 150 grams of said halide per liter of solution at an anode electrode in which the electrochemically active elements are separated from the electron current conducting structure and are bonded at a plurality of points to the membrane facing the anode compartment, contacting the bonded electrode with an electron current conducting structure to apply an electrolyzing voltage, electrolyzing water at a cathode electrode to form caustic introducing a pressurized aqueous feed to the buffer compartment to form caustic in the buffer compartment and to establish a positive pressure differential which forces the membranes forming the buffer compartment outwardly to maintain firm contact between the unitary anode-membrane and the electron current conducting structure to minimize the voltage required for electrolysis, removing caustic solutions of differing concentrations from the cathode and buffer compartments.

15. The process according to claim 14 wherein the anode and cathode bonded to the membranes comprise a plurality of electrochemically active particles bonded to the membrane and to polymeric fluorocarbon particles.

16. The process according to claim 15 wherein the electron current conducting structures in contact with the anode and cathode respectively have higher chlorine and hydrogen overvoltages than the anode and cathode.

17. The process according to claim 14, wherein the buffer compartment is maintained at a positive pressure differential of at least 0.5 psi.

18. The process according to claim 14, wherein the positive buffer compartment pressure differential is 1–2 psi.

19. The process according to claim 14 wherein the cathode electrode is bonded at a plurality of points to the membrane facing the cathode compartment and is in contact with an electron current conducting structure.

20. The process according to claim 14 wherein the electron current conducting structure in contact with the anode has a higher chlorine overvoltage than the anode.

21. An electrolytic cell for the electrolysis of aqueous compounds comprising:

(a) a housing, (b) at least two ion transporting membranes separating said housing into anode, cathode, and buffer compartments, (c) anode and cathode electrodes at which electrolysis takes place positioned in said anode and cathode compartments, at least one of said electrodes being physically bonded to an associated membrane at a plurality of points to form a unitary electrode-membrane structure so that the electrochemically active elements are part of the membrane.

(d) an electron current conducting structure positioned in contact with the electrode bonded to the membrane for applying an electrolyzing potential to the electrochemically active bonded electrode, (e) means for introducing anolyte and catholyte to the anode and cathode compartment, (f) means to maintain the buffer compartment at a greater pressure than the anode and cathode compartments to force the membranes outward and the unitary electrode-membrane into firm contact with the electron current conducting structure.

(g) means to remove electrolysis products from the compartments.

22. The electrolytic cell according to claim 21 including means to introduce a pressurized aqueous solution into said buffer compartment.

23. The electrolytic cell according to claim 22 wherein the anode membrane comprises a plurality of electrochemically active particles bonded to the surface of the membrane facing the anode compartment.

24. The electrolytic cell according to the claim 22 wherein the cathode comprises a plurality of electrochemically active particles bonded to the surface of the membrane facing the cathode compartment.

25. The electrolytic cell according to claim 22 wherein both the anode and the cathode comprise a plurality of electrochemically active particles bonded directly to the surface of the membranes facing the anode and cathode compartments respectively.

26. The electrolytic cell according to claim 22 wherein the electron current conducting structures positioned in contact with the anode and cathode electrodes bonded to the individual membranes are metallic screens which have overvoltages for the electrolysis products which are greater than those of the electrodes bonded to the membranes.

* * * * *